United States Patent [19]

Siwersson et al.

[11] 4,029,485

[45] June 14, 1977

[54] GAS CLEANERS

[75] Inventors: Olle Lennart Siwersson; Karl Gunnar Tell, both of Helsingborg, Sweden

[73] Assignee: AB S.T. Miljoteknik, Helsingborg, Sweden

[22] Filed: Aug. 8, 1975

[21] Appl. No.: 603,090

[52] U.S. Cl. ..... 55/113; 55/120; 55/136; 55/139; 55/141; 55/150; 55/154; 55/340; 55/392; 55/408; 55/414; 55/423

[51] Int. Cl.² ..... B03C 03/10

[58] Field of Search ..... 55/113, 117, 118, 120, 55/122, 134, 136–139, 141, 146, 149, 150, 154, 127, 107, 14, 400, 339, 340, 391, 392, 407, 408, 414, 423

[56] References Cited

UNITED STATES PATENTS

| | | | |
|---|---|---|---|
| 1,288,126 | 12/1918 | Muller | 55/414 |
| 1,412,248 | 4/1922 | Laughlin | 55/149 X |
| 1,456,044 | 5/1923 | Strong | 55/149 |
| 1,794,615 | 3/1931 | Hoss | 55/136 |
| 1,794,616 | 3/1931 | Hoss | 55/136 |
| 1,947,447 | 2/1934 | Brassert et al. | 55/113 X |
| 2,567,709 | 9/1951 | Hedberg | 55/154 X |
| 2,616,516 | 11/1952 | Lindbergh et al. | 55/149 X |
| 2,853,150 | 9/1958 | Lenehan | 55/141 X |
| 3,054,553 | 9/1962 | White | 55/139 X |
| 3,440,800 | 4/1969 | Messen-Jaschin | 55/122 |
| 3,492,790 | 2/1970 | Ebert | 55/122 X |
| 3,518,462 | 6/1970 | Brown | 55/136 X |
| 3,526,081 | 9/1970 | Kusters | 55/127 |
| 3,603,062 | 9/1971 | Robbins et al. | 55/423 X |
| 3,668,835 | 6/1972 | Vicard | 55/138 X |
| 3,744,218 | 7/1973 | Ebert | 55/150 X |
| 3,763,632 | 10/1973 | Imris | 55/150 X |
| 3,816,980 | 6/1974 | Schwab | 55/136 X |
| 3,831,349 | 8/1974 | Siwersson et al. | 55/113 |

FOREIGN PATENTS OR APPLICATIONS

| | | | |
|---|---|---|---|
| 116,325 | 2/1930 | Austria | 55/149 |
| 833,798 | 3/1952 | Germany | 55/137 |
| 309,149 | 7/1930 | United Kingdom | 55/120 |

*Primary Examiner*—Frank W. Lutter
*Assistant Examiner*—Kathleen J. Prunner
*Attorney, Agent, or Firm*—Karl W. Flocks

[57] ABSTRACT

An electrostatic filter type gas cleaner having relatively electrically insulated discharge and collecting electrodes between which the gas to be cleaned is passed. The collecting electrodes are mounted concentrically around the discharge electrodes and are rotatable relative to them so that particles separating from the gas and depositing on the collecting electrodes are almost immediately thrown away from these electrodes. A casing surrounds the collecting electrodes and serves to collect and carry away the particles separated from the gas. The interior space of the casing is not influenced by the gas flow between the discharge and collecting electrodes. Moreover, means are provided at the peripheral part of a prolongation, extending in the direction of the gas stream, of the annular gap between the discharge and collecting electrodes to lead off the peripheral portion of the gas stream radially outwards to a separate outlet.

5 Claims, 1 Drawing Figure

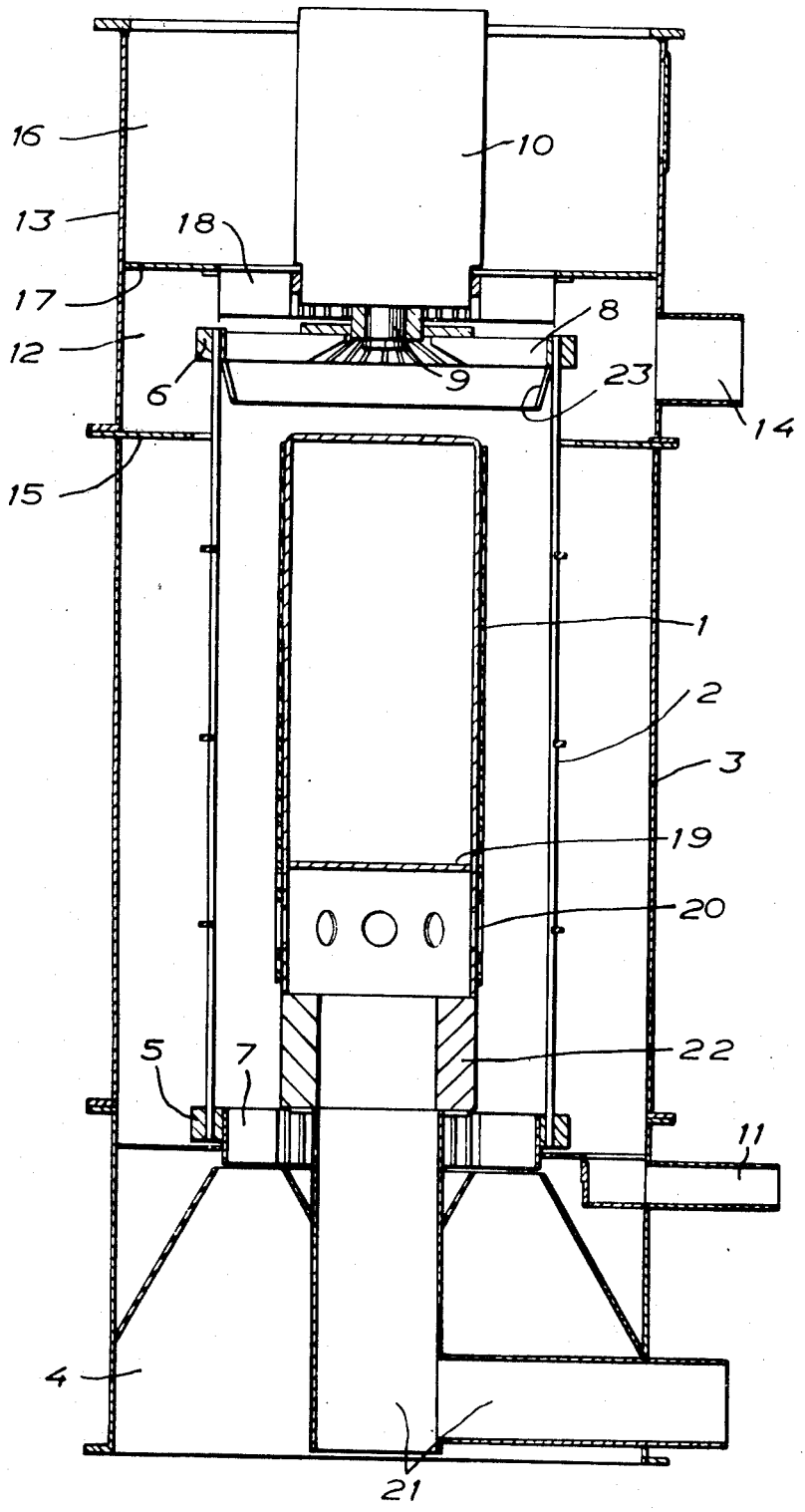
16
10
13
18
17
8
12
9
23
6
14
15
1
2
3
19
20
5
7
22
11
4
21

GAS CLEANERS

The present invention relates to an electrostatic filter type gas cleaner including relatively electrically insulated discharge and collecting electrodes which have a voltage applied to them to cause particles in a gas stream passing between said electrodes to migrate towards and deposit on the collecting electrodes which are mounted around the discharge electrodes for rapid rotation around them and define on their sides facing away from the discharge electrodes a space which is otherwise closed in a gas-tight manner by an external casing, whereby kinetic energy is imparted to the particles depositing on the collecting electrodes so that they are thrown by centrifugal force outwards into the external space. More particularly this invention is an improvement of the gas cleaner described in U.S. Pat. No. 3,831,349, said improvement making it possible to attain a higher degree of separation for the finest particles in the gas to be cleaned.

The improved separation efficiency is achieved according to this invention in that means are provided at the peripheral part of a prolongation, extending in the direction of the gas stream, of the annular gap between the discharge and collecting electrodes to lead off the peripheral portion of the gas stream radially outwards to a separate outlet.

This invention thus permits separating such particles as have not been separated by the electrostatic filter proper and, consequently, are smaller than the particles separated by the electrostatic filter. The additional separation according to this invention will therefore take place immediately before the outlet of the gas cleaner. This makes it possible to separate particles which are smaller than those which are separable with the gas cleaner according to the patent application mentioned above. To achieve a corresponding effect in the prior art gas cleaner, a considerable prolongation of the discharge and collecting electrodes in the axial direction would be required.

The invention will be described more in detail hereinbelow with reference to the accompanying drawing which illustrates a diagrammatic longitudinal section of a preferred embodiment of the invention.

The gas cleaner illustrated in the drawing comprises a plurality of discharge electrodes 1 arranged along a cylinder surface, a plurality of collecting electrodes 2 arranged along a second cylinder surface concentrically around the discharge electrodes 1 and electrically insulated from them, an annular casing 3 enclosing the collecting electrodes 2, and a gas inlet 4 connected onto the gap between the discharge electrodes 1 and the collecting electrodes 2 and united with the casing.

The discharge electrodes 1 may be thin wires or a grid which is electrically conductive and may be arranged on the outside of a cylindrical body. Moreover, the discharge electrodes 1 are electrically connected, in a manner not shown, to a suitably negative voltage relative to that of the collecting electrodes 2 which are usually connected to ground.

The collecting electrodes 2 may be axially extending wires or vanes which are electrically conductive and secured between a lower ring 5 and an upper ring 6. Mounted on the inside of the lower ring 5 are axial blower blades 7 bordering on the upper ring-shaped part of the inlet 4. The upper ring 6 is connected, by means of spokes 8 formed as axial blower blades, to a shaft 9 which, together with the collecting electrodes 2, is rotatable by means of a motor 10.

The space of the casing 3 inwardly defined by the collecting electrodes 2 has in its upper portion flushing means (not shown) and at its bottom a gas-tight liquid drain 11.

The collecting electrodes 2 extend in the direction of the gas stream past the casing 3 and the portion of said electrodes which is disposed above the casing defines the inner side of a chamber 12 arranged above the casing and defining a second space, said chamber being defined outwardly by a cylindrical housing 13 which is connected with the casing and has an outlet 14 opening into the chamber. At its bottom the chamber 12 is defined by the upper, planar and ring-shaped wall 15 of the casing 3 while the chamber at its top is delimited from the outlet 16 of the gas cleaner by a likewise planar and ring-shaped intermediate wall 17 at the inner edge of which guide vanes 18 cooperating with the blades 8 are mounted.

The cylindrical body supporting the discharge electrodes 1 may be hollow and provided with an intermediate wall 19. The space below the intermediate wall 19 communicates, on one hand, through apertures 20 with the gap between the discharge and collecting electrodes 1 and 2 and, on the other hand, with a conduit 21 passing through the inlet. This conduit 21 can be connected with the outlet 14 of the chamber 12. The cylindrical body and the discharge electrodes are insulated from the other parts of the gas cleaner by a ring-shaped insulator 22.

In operation of the gas cleaner, the gas to be cleaned from particles suspended therein is driven into the gap by axial blower blades 7 and 8 between the discharge and collecting electrodes 1 and 2 from the inlet 4 and voltage is applied between the discharge and the collecting electrodes, which latter electrodes have been set in rapid rotation by the motor 10. Passing through the gap, the gas is ionized because of corona discharge at the discharge electrodes 1, and the particles suspended in the gas are charged so as to be attracted by and deposit on the collecting electrodes 2. Due to the rapid rotation of the collecting electrodes 2, kinetic energy is imparted to the separated particles which are thrown by centrifugal force outwards from the collecting electrodes into the space of the casing 3, where they are carried along by flushing liquid from the flushing means mounted therein and leave through the gas-tight drain 11. The gas cleaned from particles is discharged through the outlet 16 and led off in a desired manner.

As the amount of the charging of the particles is directly related to the particle size, the finest particles, during the flow of the gas through the gas cleaner, will migrate more slowly towards the collecting electrodes than will the relatively coarser particles. An overwhelming majority of the fine particles not separated out from the gas by the gas cleaner will therefore, immediately before the outlet 16 of the gas cleaner, be concentrated to the zone immediately inwardly of the collecting electrodes 2, i.e. to the peripheral portion of the gas stream in the zone where the gas leaves the gas cleaner. A substantial increase of the separation efficiency can therefore be obtained according to this invention in that the portion of the gas stream passing immediately inwardly of the upper part of the collecting electrodes 2 is prevented from reaching the outlet 16 and is instead diverted to a separate outlet, e.g.

through the collecting electrodes, outwards into the chamber 12 and is carried away through the outlet 14.

The gas stream passing through the outlet 14 can be conducted to the conduit 21, which opens inwardly of the discharge electrodes 1, and be led outwards through these electrodes and the apertures 20 into the gap between the discharge and collecting electrodes 1 and 2. When passing through the discharge electrodes 1, the fine particles suspended in the gas will be heavily charged, which increases the probability of these particles depositing on the portion of the collecting electrodes 2 inwardly of the casing 3 when passing again through the gas cleaner. This will thus make it possible to obtain a considerable increase of the total separation efficiency of the gas cleaner.

In order further to increase the separation efficiency the discharge electrodes 1 may be divided up into preferably two sections which are separated in the direction of the gas stream, insulated from each other and having applied to them voltages increasing in the direction of the gas stream. In this case the discharge electrodes in the section close to the inlet 4 are designed so that the highest possible charging of the particles suspended in the passing gas will be obtained by corona discharge. The discharge electrodes of the other section, however, are designed so as not to produce any corona discharge and these may have applied to them a higher voltage relative to the collecting electrodes.

For the same purpose of increasing the separation efficiency a conical flange 23 directed towards the gas stream may be disposed inwardly of the portion of the collecting electrodes 2 defining the chamber 12, in order to divert to the chamber 12 and the outlet 14 the portion of the gas stream which is close to the collecting electrodes. This flange is preferably an insulator having well rounded edges.

Liquid sprayers may likewise be arranged inwardly of that portion of the collecting electrodes 2 defining the chamber 12 to establish a curtain of finely divided liquid directed towards this portion. Such moistening may also take place at other points and recirculation of the moistened gas will facilitate the charging of the highly resistive particles suspended in the gas. The gas conducted from the outlet 14 to the conduit 21 may be allowed to pass a condenser, which results in further separation of the finest particles.

Returning the gas stream from the outlet 14 also permits agglomeration of the fine particles, which will make it easier to separate them during their second passage through the gas cleaner.

The outlet can also be connected to another gas cleaner which is specifically dimensioned for the fine particles.

By arranging a plurality of chambers like the chamber 12 it will also be possible to fraction the particles suspended in the gas stream.

Also the discharge electrodes can be mounted for rotation. This will make it possible to remove from the discharge electrodes such particles as are positively charged in the corona and thus are attracted by the negative discharge electrodes. This phenomenon occurs only in the layer adjacent to the discharge electrodes and can be prevented to some extent in that the gas stream entering from the inlet is somewhat directed towards the collecting electrodes by giving the inlet 4 and/or the apertures 20 a suitable configuration.

The embodiment of the invention described in the foregoing with reference to the drawing is only an example and is not limitative. A suitable modification of said embodiment which lies within the scope of this invention will be described below. According to this modification the collecting electrodes 2 are borne and driven at the portion thereof closest to the gas inlet 4 and extend upwards approximately flush with the discharge electrodes 1, with the spokes 8, the shaft 9, the motor 10 and the guide vanes 18 being removed. The ring 23 may be mounted on the intermediate wall 17 or in some other suitable manner and forms thus means in the zone where the gas leaves the gas cleaner for diverting the peripheral portion of the gas stream to the outlet 14 which in that case, together with the chamber 12, can be of another configuration than that shown in the drawing. In that case the ring 23 need not consist of insulating material but may be electrically conductive and have some suitable voltage applied to it and/or be magnetic or magnetizable, and in this connection also a magnetic field is utilized for particle separation.

The reason of the removal of the above-mentioned elements in this modified embodiment is of course that no turbulence is allowed to occur in the gas having passed the gap between the discharge and collecting electrodes, i.e. the particles which after passing this gap are contained in the peripheral portion of the gas stream must not be so influenced that they would not be carried away to the separate outlet by the diverting means.

What we claim and desire to secure by Letters Patent is:

1. In a gas cleaning apparatus of the electric precipitator type having a gas inlet;

a gas outlet;

a plurality of discharge and collecting electrodes, said discharge electrodes being mounted stationary in the shape of an inner cylinder surface configuration, being insulated from said collecting electrodes and being separated therefrom to form a gap therebetween, said collecting electrodes being mounted in the shape of an outer concentrical cylinder surface configuration, concentric with said discharge electrodes, for rotation around said discharge electrodes, voltage source means to apply a voltage to said discharge and collecting electrodes, and said gap between said cylinder surface configurations being annular and connecting at opposite ends with said gas inlet and said gas outlet;

means for forcing a gas stream to be cleaned from particles suspended therein from said gas inlet through said annular gap between said discharge and collecting electrodes to said gas outlet;

means for rapidly rotating said collecting electrodes; and a casing with extensions to the outer side of said collecting electrodes for defining an outwardly closed space, whereby a radially directed electric field is established between said discharge and collecting electrodes when a voltage is applied by said voltage source, said particles in said gas stream are attracted by said collecting electrodes for deposition thereon, and particles deposited on said collecting electrodes have kinetic energy imparted to them such that they are thrown out into said space between said collecting electrodes and said casing by centrifugal force;

the improvement wherein means are provided between said gas outlet and said annular gap between said discharge and collecting electrodes for leading off radially outwards a peripheral portion of the gas stream leaving said annular gap between said discharge and collecting electrodes, and a separate gas outlet communicating with said annular gap and said means for leading off the peripheral portion of the gas stream for carrying away said led off portion of the gas stream.

2. A gas cleaner as claimed in claim 1, wherein the collecting electrodes extend past the spaced closed by the casing toward said gas outlet and partially define at least a second external space to which said separate outlet is connected.

3. A gas cleaner as claimed in claim 2, wherein said means for leading off the peripheral portion of the gas stream includes a flange disposed inwardly of the part of the collecting electrodes connecting with second space and directed towards said annular gap for leading off the portion of the gas stream adjacent the collecting electrodes to the second space.

4. A gas cleaner as claimed in claim 1, wherein a conduit is connected to the gap between the discharge and collecting electrodes and said separate outlet for returning the gas passing out from the separate gas outlet.

5. A gas cleaner as claimed in claim 4, wherein the conduit opens inwardly of the discharge electrodes and at that portion thereof close to the gas inlet for conducting the gas stream of the separate gas outlet through the discharge electrodes to the gap between the discharge and collecting electrodes.

* * * * *